US005806448A

United States Patent [19]

Matsuo et al.

[11] Patent Number: 5,806,448

[45] Date of Patent: Sep. 15, 1998

[54] OVERLOCK SEWING MACHINE

[75] Inventors: Osamu Matsuo; Yoshikazu Suzuki, both of Moriguchi, Japan

[73] Assignee: Jaguar Co., Ltd., Osaka, Japan

[21] Appl. No.: 750,193

[22] PCT Filed: Mar. 29, 1995

[86] PCT No.: PCT/JP95/00588

§ 371 Date: Nov. 27, 1996

§ 102(e) Date: Nov. 27, 1996

[87] PCT Pub. No.: WO96/30579

PCT Pub. Date: Oct. 3, 1996

[51] Int. Cl.[6] ..... D05B 1/14; D05B 47/04

[52] U.S. Cl. ..... 112/162; 112/168; 112/254

[58] Field of Search ..... 112/162, 168, 112/475.26, 254, 255

[56] References Cited

U.S. PATENT DOCUMENTS 5,216,970 6/1993 Sakuma ..... 112/168

FOREIGN PATENT DOCUMENTS 59-34780 3/1984 Japan .
59-46992 3/1984 Japan .
62-58582 4/1987 Japan .
62-94196 4/1987 Japan .
62-194892 8/1987 Japan .
62-152493 6/1990 Japan .

*Primary Examiner*—Peter Nerbun
*Attorney, Agent, or Firm*—McDermott, Will & Emery

[57] ABSTRACT

An overlock sewing machine which can readily form a rolled seam with no requirement for a complicated tension adjusting operation is disclosed. In this overlock sewing machine, an auxiliary thread tensioner (15) is provided independently of a main thread tensioner (4), providing a lower looper thread (9) with thread tension which is necessary for forming an over-edge chain stitch, in the vicinity thereof. An end cam (25) is provided on a shaft (13) of a dial (12) for feed adjustment, so that an upper pawl (23) rams one portion of the peripheral edge of a tension disc (20) and expands a side which is opposed thereto for canceling tension provision to the lower looper thread (9) passed through tension discs and provides the tension only by the main thread tensioner (4) to carry out an ordinary over-edge chain stitch when a lower pawl (24) is engaged with a high lift part of the end cam (25). In a rolled seam, the lower pawl (24) is engaged with a lower lift part of the end cam (25) by a rotational operation of the dial (12), and the upper pawl (23) is detached from the tension disc (20). Thus, tension which is provided by the auxiliary thread tensioner (15) in addition to the main thread tensioner (4) is applied to the lower looper thread (9), and it is not necessary to carry out tension adjustment in switching between the over-edge chain stitch and the rolled seam.

8 Claims, 10 Drawing Sheets

OVERLOCK SEWING MACHINE

FIELD OF THE INVENTION

The present invention relates to an overlock sewing machine, and more particularly, it relates to an overlock sewing machine which can readily switch from an ordinary over-edge chain stitch to a rolled seam.

BACKGROUND TECHNIQUE

In general, a rolled seam is formed by employing an overlock sewing machine with one needle and three threads or an overlock sewing machine with one needle and two threads comprising a hook looper, replacing a presser foot and a needle plate with those for the rolled seam, and increasing the tension of a lower looper thread or a looper thread (hereinafter referred to as a bobbin thread) while reducing the feed rate. FIG. 1 shows an ordinary over-edge chain stitch which is formed by a conventional overlock sewing machine with one needle and three threads, and FIG. 2 shows a conventional rolled seam which is formed by increasing bobbin thread tension (to about twice that in an ordinary over-edge chain stitch) and reducing the feed rate for retracting an upper looper thread to the back side of cloth while reducing the seam pitch. Referring to FIGS. 1 and 2, the over-edge chain stitch part and the rolled seam part are formed by needle threads 101, upper looper threads 102 and lower looper threads 103.

Such a rolled seam is generally employed for an over-edge chain stitch for a handkerchief or the like since the cloth edge is rolled and beautified on the upper part.

In most of conventional general overlock sewing machines, it has been necessary to replace parts such as a presser foot and a needle plate with those which are dedicated for a rolled seam while strengthening tension of a bobbin thread in the case of forming the rolled seam, as hereinabove described. In this adjustment of the tension, there has been such a problem that an adjustment operation for attaining preferable tension balance is not easy due to a seam by complicated intertwinement of a plurality of threads, and a considerable time is required as the result. This also applies to the case of returning the operation from the rolled seam to an ordinary over-edge chain stitch, and there has been such a problem that the presser foot and the needle plate are changed to ordinary standard parts while a complicated adjustment operation for attaining preferable tension balance which is suitable for the over-edge chain stitch is required.

DISCLOSURE OF THE INVENTION

An object of the present invention is to provide an overlock sewing machine which can readily perform switching from an over-edge chain stitch to a rolled seam or reverse switching without carrying out a complicated tension adjustment operation.

The overlock sewing machine according to the present invention comprises a main thread tensioner for providing a bobbin thread with thread tension which is necessary for forming an ordinary over-edge chain stitch, and an auxiliary thread tensioner for providing the bobbin thread with thread tension which is necessary for forming a rolled seam along with the main thread tensioner. Thus, it is not necessary to carry out adjustment of the thread tension for forming a rolled seam or returning the rolled seam to an ordinary over-edge chain stitch and tension balance which is once attained may not be changed, whereby switching from the over-edge chain stitch to the rolled seam or reverse switching is simplified. Further, tension adjustment ranges can be narrowed in both of the main thread tensioner and the auxiliary thread tensioner as compared with that carrying out tension adjustment in a wide range from the over-edge chain stitch to the rolled seam with one thread tensioner by one thread tensioner, whereby the degree of freedom in design of the thread tensioners is advantageously increased.

In the overlock sewing machine according to the present invention, the bobbin thread is guided along the main thread tensioner and the auxiliary thread tensioner for the rolled seam to be provided with thread tension from the two thread tensioners, while the bobbin thread is guided along only the main thread tensioner for the over-edge chain stitch along a thread path which is different from that for the rolled seam not to be passed through the auxiliary thread tensioner, or passed through the auxiliary thread tensioner along the same path as that for the rolled seam and tension provision of the auxiliary tensioner is canceled. When the tension provision is canceled, switching of the auxiliary thread tensioner between action and inaction, i.e., switching between provision of tension and cancellation thereof is carried out by operation of a manual operation member such as a dial, a lever, a push button or a foot pedal which is provided on an outer side of the sewing machine. In order to carry out this switching, it is possible to employ a method of separating one of a pair of tension discs, which are elastically brought into contact with each other by a spring, by a tension releasing pin against action of the spring, a method of pushing a portion of the peripheral edge of one of the pair of tension discs with a pawl for inclining the tension disc and expanding the one which is opposed thereto through a thread tension shaft, or a method of applying a spring pressure to the tension discs or canceling this application by pushing the spring or canceling the pushing of the spring, similarly to the conventional thread tensioner, for example.

According to the inventive overlock sewing machine, the thread path may be changed or the auxiliary thread tensioner may be switched between action and inaction in switching between the over-edge chain stitch and the rolled seam, and it is not necessary to carry out tension adjustment in switching of the stitch as to both thread tensioners.

When the thread path is changed, the mechanism of the auxiliary thread tensioner can be simplified since it is not necessary to provide a mechanism for bringing the auxiliary thread tensioner into an inaction state. When the auxiliary thread tensioner can be switched between action and inaction, it is preferable to make the feed rate adjustable in association with this switching operation, i.e., a switching mechanism for the auxiliary thread tensioner and a feed rate adjusting mechanism are preferably interlocked with each other so that the feed rate is increased when the auxiliary thread tensioner is brought into an inaction state to carry out an over-edge chain stitch while the feed rate is reduced when a rolled seam is formed through action of the auxiliary thread tensioner. To this end, an end cam for switching the auxiliary thread tensioner may be provided on a shaft of a dial for feed rate adjustment to drive the aforementioned tension releasing pin or pawl or to push the spring or cancel the pushing by the cam.

When the switching mechanism for the auxiliary thread tensioner and the feed rate adjusting mechanism are interlocked with each other, it is preferable that the feed rate can be adjusted in the over-edge chain stitch and the rolled seam respectively. To this end, the aforementioned end cam for switching which is provided on the shaft of the dial may be formed by a double-lift cam having high and low two types of lifts so that the shaft of the dial can be rotated by constant amounts respectively while not changing the state of tension provision or cancellation and the feed rate adjustment is carried out in the respective rotation ranges.

In another overlock sewing machine according to the present invention, therefore, a switching mechanism for switching the auxiliary thread tensioner to action or inaction is provided. Thus, the thread path may not be changed in switching between an over-edge chain stitch and a rolled seam. When the switching mechanism and the feed rate adjusting mechanism are formed to be interlocked with each other, switching of the auxiliary thread tensioner to action or inaction and adjustment of the feed rate can be carried out by operation of one manual operation member. In the other overlock sewing machine according to the present invention, further, adjustment of the feed rate can be carried out in switching between the over-edge chain stitch and the rolled seam respectively in an overlock sewing machine interlocking the switching mechanism for the auxiliary thread tensioner and the feed rate adjusting mechanism with each other. Thus, the feed rate can be adjusted also in the rolled seam in addition to the over-edge chain stitch.

In the other overlock sewing machine according to the present invention, further, the cam for switching the auxiliary thread tensioner to action or inaction is formed as a double-lift end cam having high and low two types of lifts, and mounted on the shaft of the dial of the feed rate adjusting mechanism. Thus, the end cam can be rotationally operated through the feed rate adjusting mechanism.

In the other overlock sewing machine according to the present invention, further, the main thread tensioner and the auxiliary thread tensioner are so arranged that the thread paths of the respective thread tensioners are positioned in the same plane so that threads can be readily passed through the thread tensioners. Thus, thread passage can be carried out by unidirectionally operating the threads on the aforementioned same plane.

DETAILED DESCRIPTION OF THE PREFERRED EMBODIMENTS

First, an overlock sewing machine with one needle and three threads according to an embodiment of the present invention is described with reference to FIGS. 3 and 4.

Figure 1:
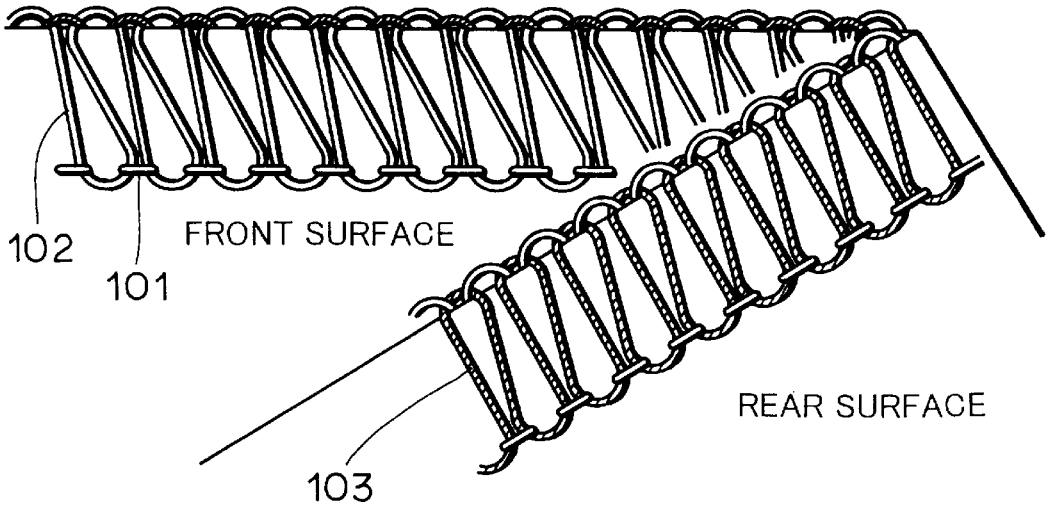
FIG. 1 PRIOR ART
FIG. 1 is a perspective view showing a conventional ordinary over-edge chain stitch with one needle and three threads.
Figure 2:
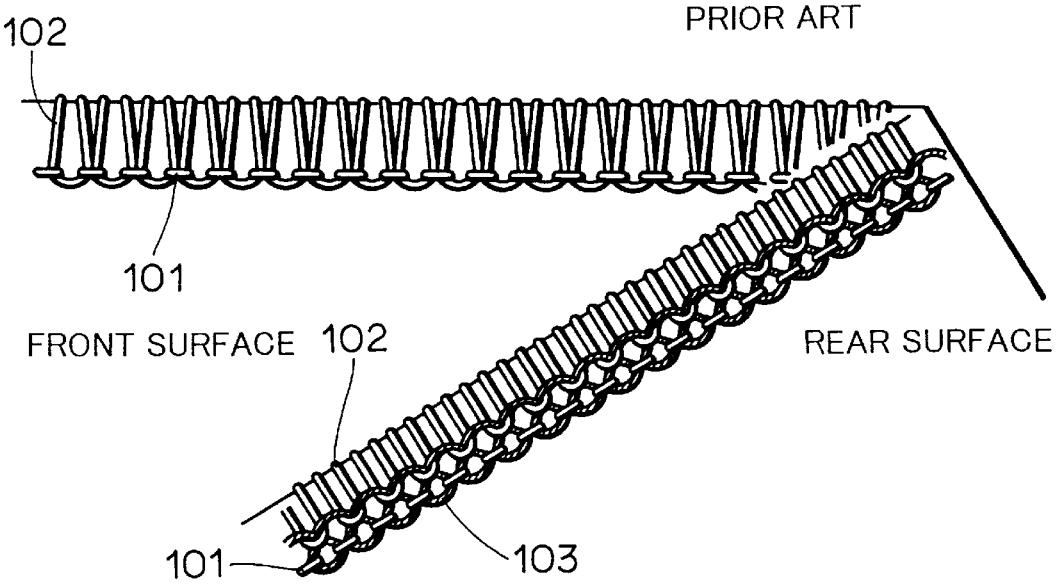
FIG. 2 PRIOR ART
FIG. 2 is a perspective view showing a conventional rolled seam with one needle and three threads.
Figure 3:
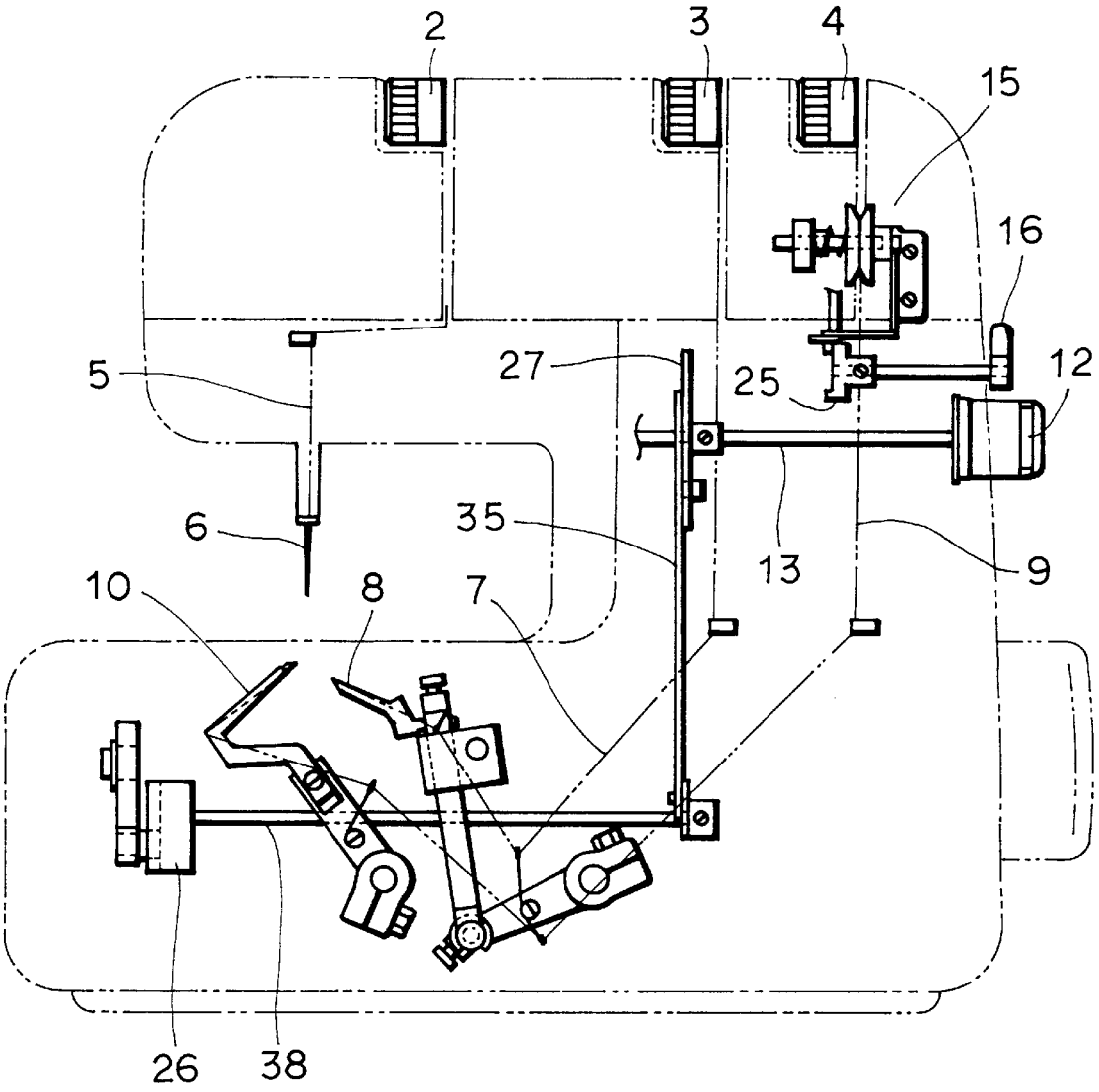
FIG. 3 is a front elevational view showing an overlock sewing machine with one needle and three threads according to an embodiment of the present invention.
Figure 4:
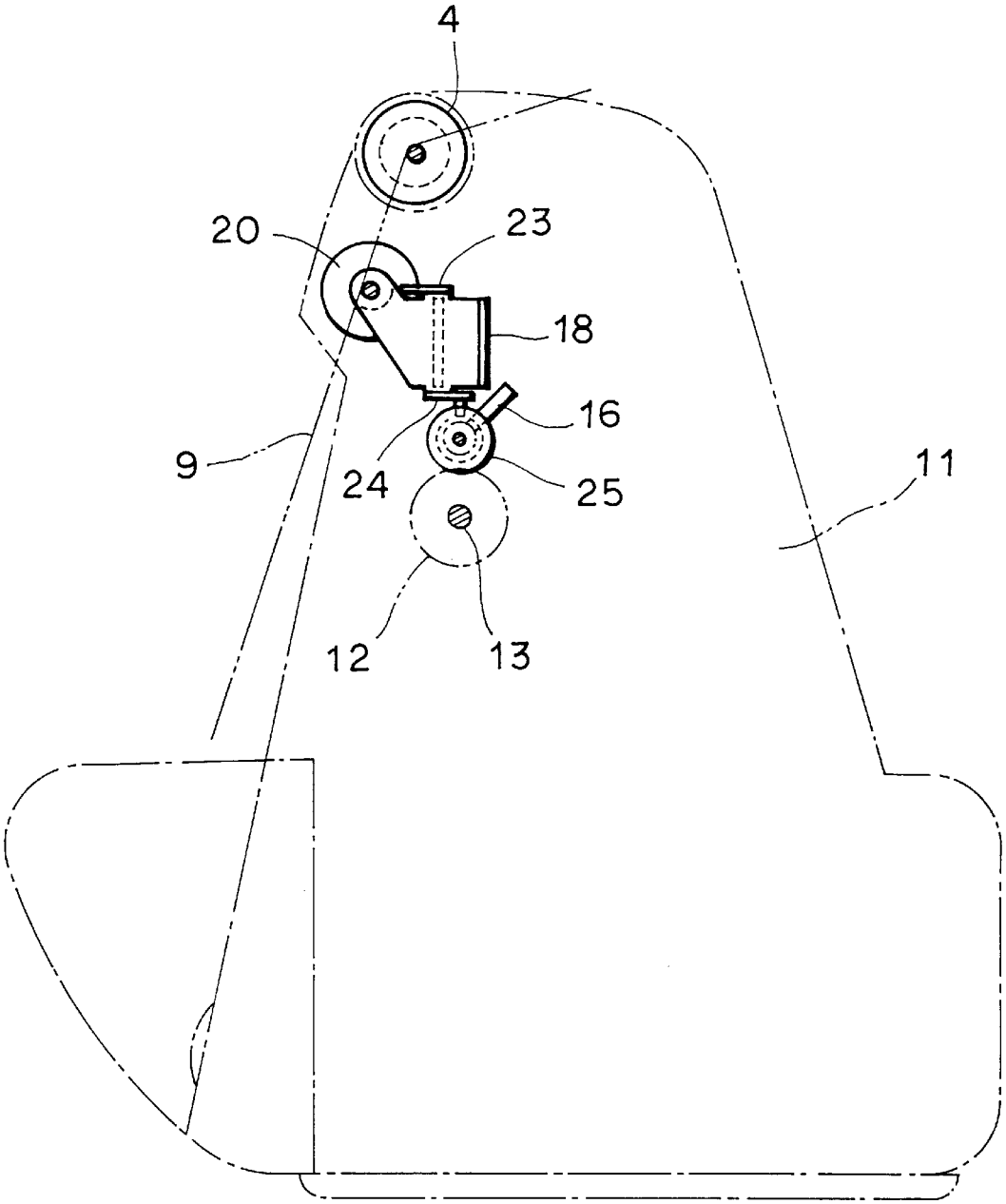
FIG. 4 is a side elevational view of the overlock sewing machine shown in FIG. 3.

As shown in FIG. 3, a thread tensioner 2 for a needle thread, a thread tensioner 3 for an upper looper thread and a thread tensioner 4 for a lower looper thread are arranged on a front surface upper part of a sewing machine cover 1. A needle thread 5 passed through the thread tensioner 2 by a spool which is not shown, an upper looper thread 7 passed through the thread tensioner 3, and a lower looper thread 9 passed through the thread tensioner 4 are structured to be passed through a needle 6, an upper looper 8 and a lower looper 10 through prescribed thread paths respectively.

A dial 12 for fabric feed rate adjustment is protrudingly provided on a side surface of a sewing machine body 11. The fabric feed rate is adjusted by a rotational operation of this dial 12.

Figure 5:
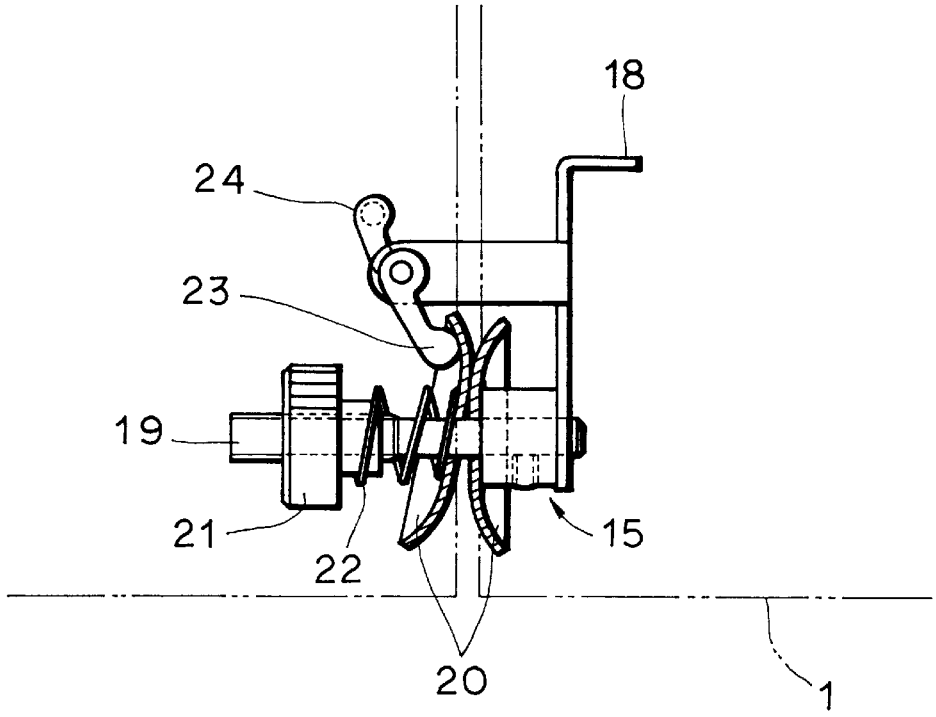
FIG. 5 is a partially fragmented plan view of an auxiliary thread tensioner in an over-edge chain stitch in the overlock sewing machine shown in FIG. 3.
Figure 6:
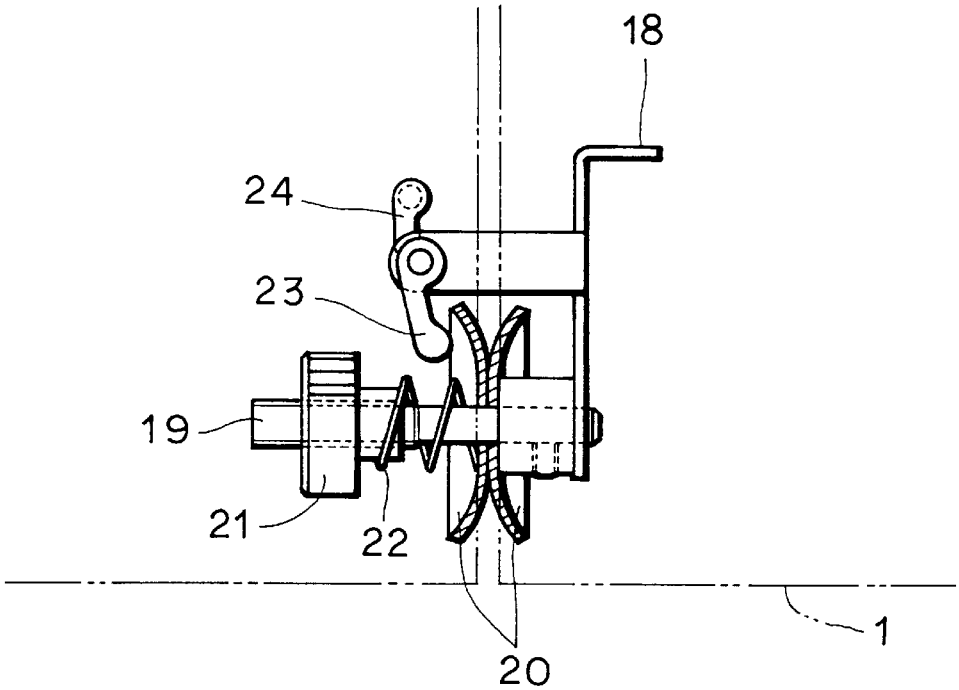
FIG. 6 is a partially fragmented plan view of the auxiliary thread tensioner upon switching to a rolled seam in the overlock sewing machine shown in FIG. 3.

In the aforementioned overlock sewing machine with one needle and three threads, an auxiliary thread tensioner 15, through which the lower looper thread 9 on the thread path is passed, is provided in the vicinity of the thread tensioner 4. Further, a switching lever 16 for switching action or inaction of the auxiliary thread tensioner 15 is provided adjacently to the dial 12. The auxiliary thread tensioner 15 includes a mount 18, a screw shaft 19 which is fastened to the mount 18 to project sideward, a pair of tension discs 20 which are slidably engaged with the screw shaft 19, a spring seat 21 which is screwed to the screw shaft 19, and a coil spring 22 which is freely engaged (movably fitted) with the screw shaft 19 between the spring seat 21 and the tension discs 20 for pressing the tension discs 20, as shown in FIGS. 5 and 6. An upper pawl 23 and a lower pawl 24 are further integrally attached to the mount 18. The upper pawl 23 is directed to the peripheral edges of the tension discs 20, while the lower pawl 24 is engaged with an end cam 25 for switching which is fixed coaxially with the switching lever 16.

In an over-edge chain stitch, the lower pawl 24 is engaged with a high lift part of the end cam 25, whereby the upper pawl 23 rams the tension disc peripheral edges to incline the tension discs 20 and to expand a portion between the tension discs on the front surface side of the sewing machine cover, so that no presser bar pressure is applied to the lower looper thread 9 which is passed between the tension discs (see FIG. 5). In a rolled seam, on the other hand, the lower pawl 24 is engaged with a lower lift part of the end cam 25 to separate the upper pawl 23 from the tension discs 20, thereby applying tension to the lower looper thread 9 which is passed between the tension discs (see FIG. 6).

As hereinabove described, the auxiliary thread tensioner is switched by the rotational operation of the switching lever 16 to inact in the over-edge chain stitch and to act in the rolled seam. Further, the lower looper thread 9 is provided with tension by the thread tensioner 4 which is set at tension suitable for the over-edge chain stitch in inaction, while the tension provided by the thread tensioner 4 and tension provided by the auxiliary thread tensioner 15 are applied to the lower looper thread 9 in action so that tension which is suitable for the rolled seam is provided.

When the operation is switched to the rolled seam, the auxiliary thread tensioner is made to act for increasing the tension which is applied to the lower looper thread 9 as described above, while a presser foot and a needle plate are replaced with parts for the rolled seam, and the feed rate is adjusted to small in general.

Figure 7:
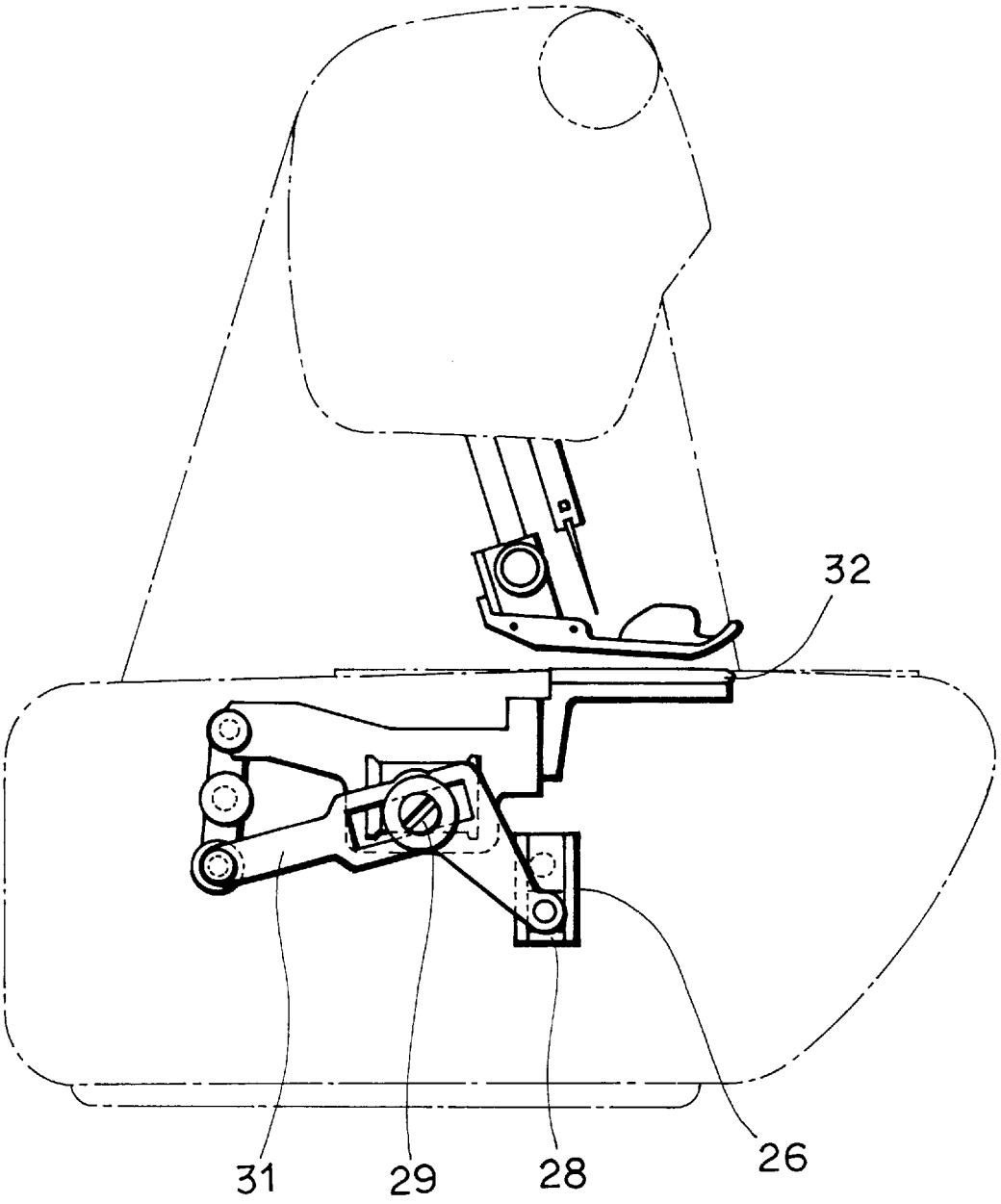
FIG. 7 is a side elevational view showing a feed mechanism of the overlock sewing machine shown in FIG. 3.

In this embodiment, adjustment of the fabric feed rate is carried out by rotationally operating the dial 12 for changing the inclination of a tension box 26 by a feed rate adjusting cam 27 which is fixed to a dial shaft 13. Namely, a slider 28 which is engaged with the tension box 26 is provided on one end with reference to FIG. 7, so that the slider 28 reciprocates along the tension box 26 by rotational driving of an eccentric shaft 29. Thus, the amount of reciprocation of a horizontal feed arm 31 reciprocating in the horizontal direction of the figure is changed by inclination of the tension box 26, whereby the amount of reciprocation of a feed dog 32, i.e., the fabric feed rate is changed.

In the aforementioned embodiment, the switching between action and inaction of the auxiliary thread tensioner 15 by the switching lever 16 and the adjustment of the fabric feed rate by the rotational operation of the dial 12 are separately carried out independently of each other. Therefore, operations of both the switching lever 16 and the dial 12 are necessary for switching between the over-edge chain stitch and the rolled seam. However, as discussed below it is also possible to enable simultaneous performance of the switching between action and inaction of the auxiliary thread tensioner and change of the feed rate only by the operation of the dial 12.

Figure 8:
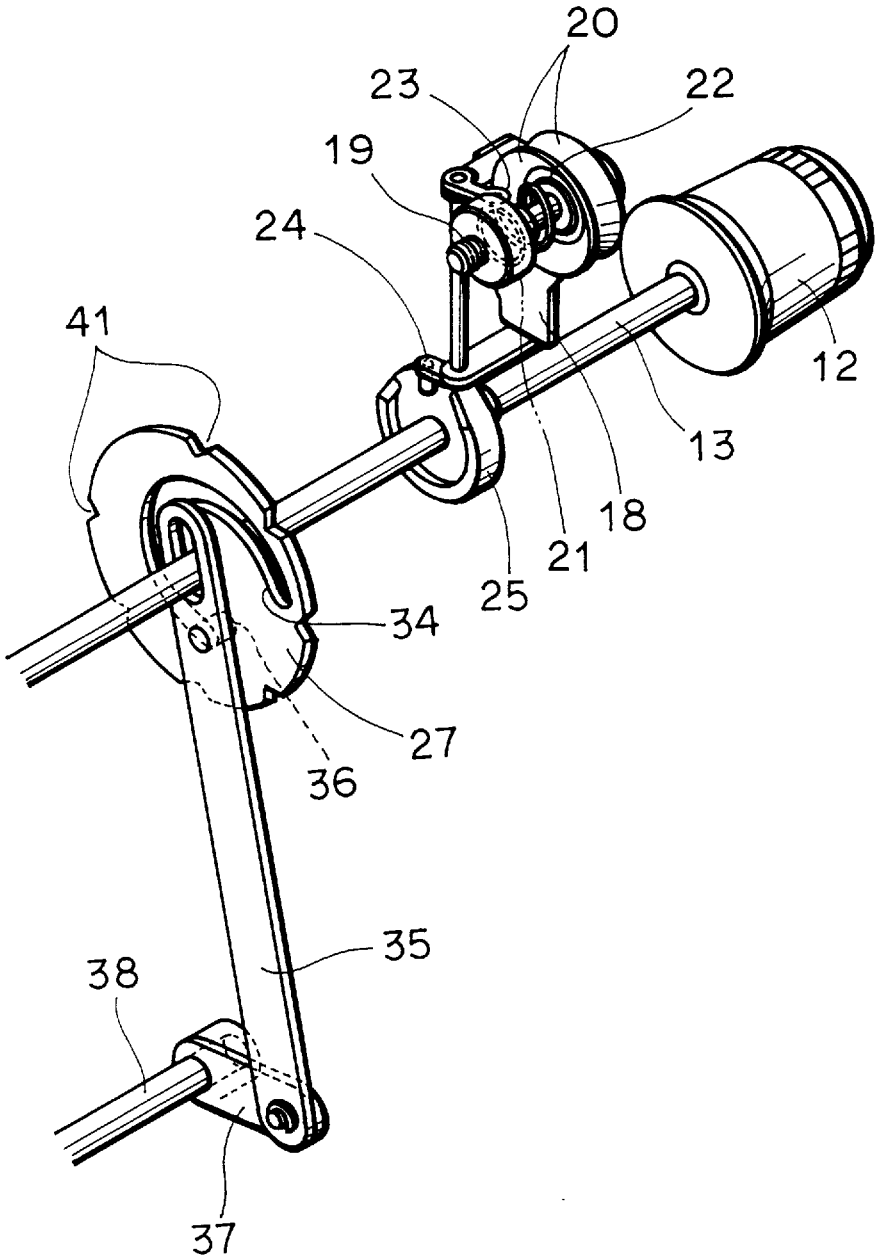
FIG. 8 is a perspective view showing another example of the switching mechanism shown in FIG. 3.
Figure 9:
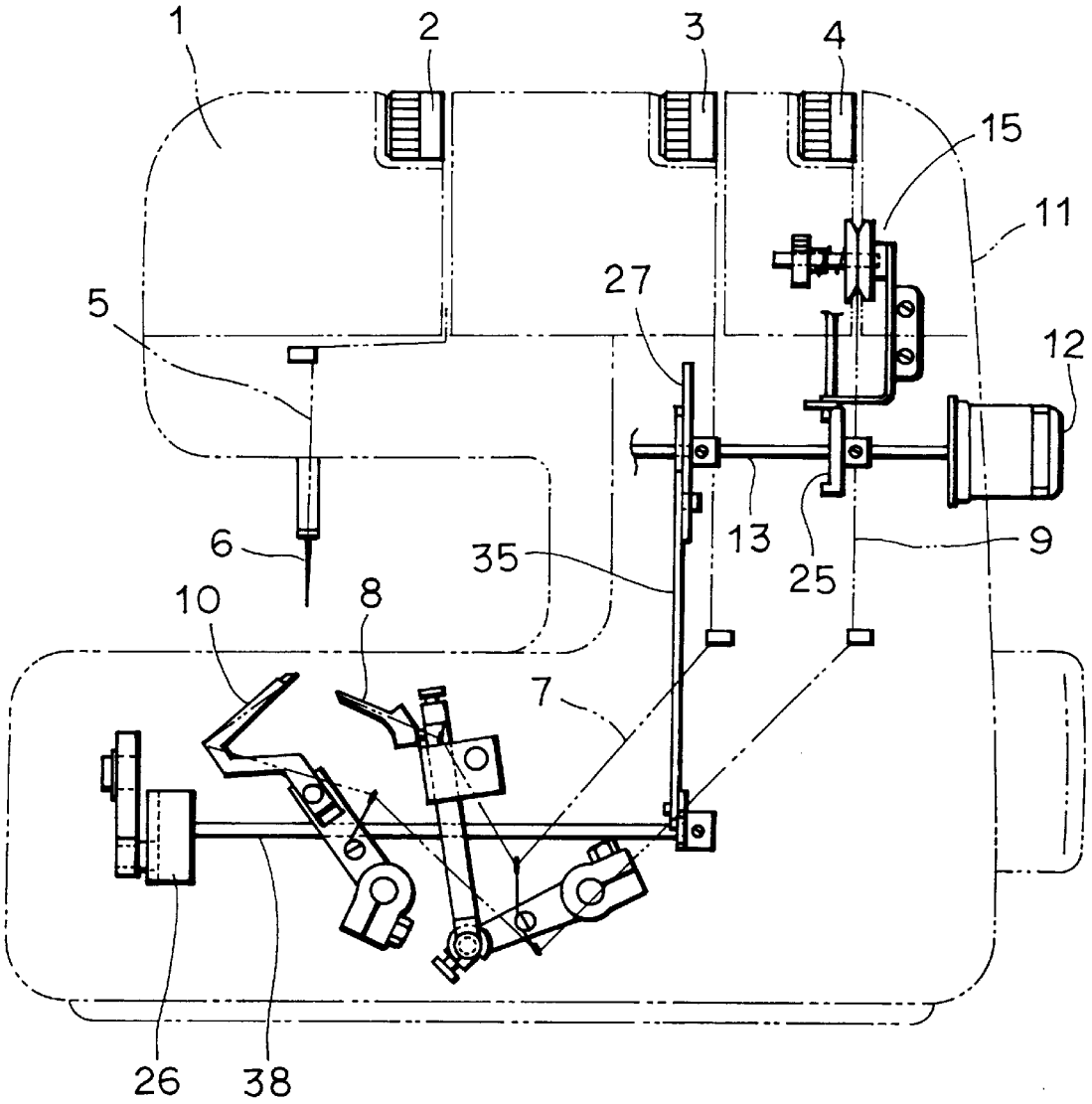
FIG. 9 is a front elevational view of an overlock sewing machine comprising the switching mechanism shown in FIG. 8.
Figure 10:
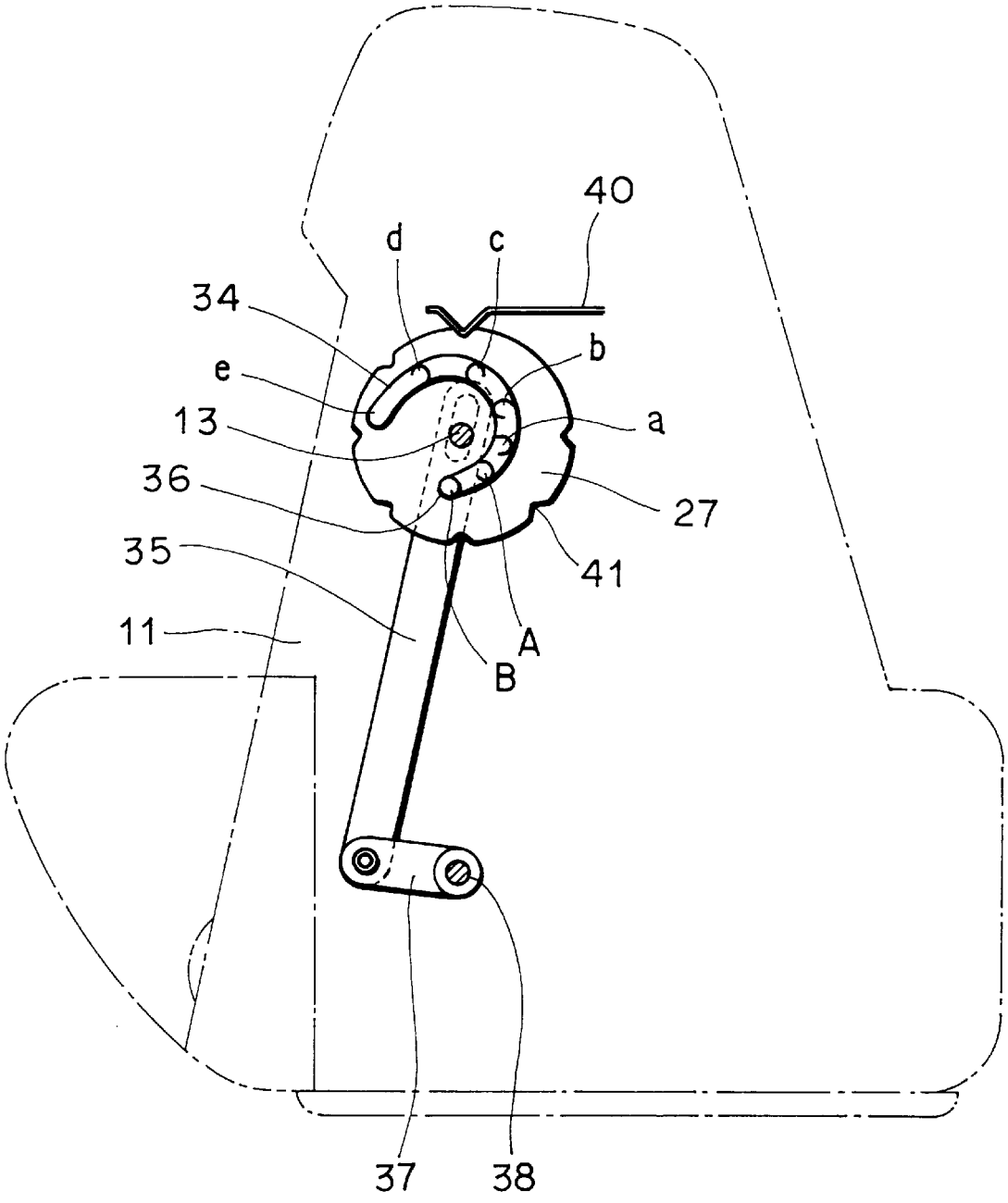
FIG. 10 is a side elevational view of the overlock sewing machine shown in FIG. 9.

FIGS. 8 to 10 show an example which is thus structured, and the aforementioned end cam 25 is mounted on a dial shaft 13 of a dial 12. In the embodiment shown in FIGS. 8 to 10, it is possible to adjust the feed rate at a time of carrying out an over-edge chain stitch and at a time of forming a rolled seam respectively. Namely, a pin 36 which is protrudingly provided on a coupling plate 35 is engaged with a cam groove 34 which is formed in a feed rate adjusting cam 27. Thus, a tension shaft 38 is rotated through the coupling plate 35 and a lever 37 by rotation of the feed rate adjusting cam 27, whereby inclination of a tension box 27 is changed. In this case, a lower pawl 24 is engaged with a high lift part of the end cam 25 so that an over-edge chain stitch is carried out until the pin 37 is in the range of cam groove parts a to e, and the feed rate is increased from the point a where the feed rate is zero toward a point b, a point c and a point d, so that the feed rate is maximized at the point e. Until the pin 37 is in the range of cam groove parts A to B, on the other hand, the lower pawl 24 is engaged with a lower lift part of the end cam 25 so that a rolled seam is formed, and the feed rate is increased from A toward B. A locating spring 40 shown in FIG. 10 is engaged with/stopped at a notch groove 41 which is formed in the peripheral surface of the feed rate adjusting cam 27, for adjustment to typical feed rates in the over-edge chain stitch and in the rolled seam.

Figure 11:
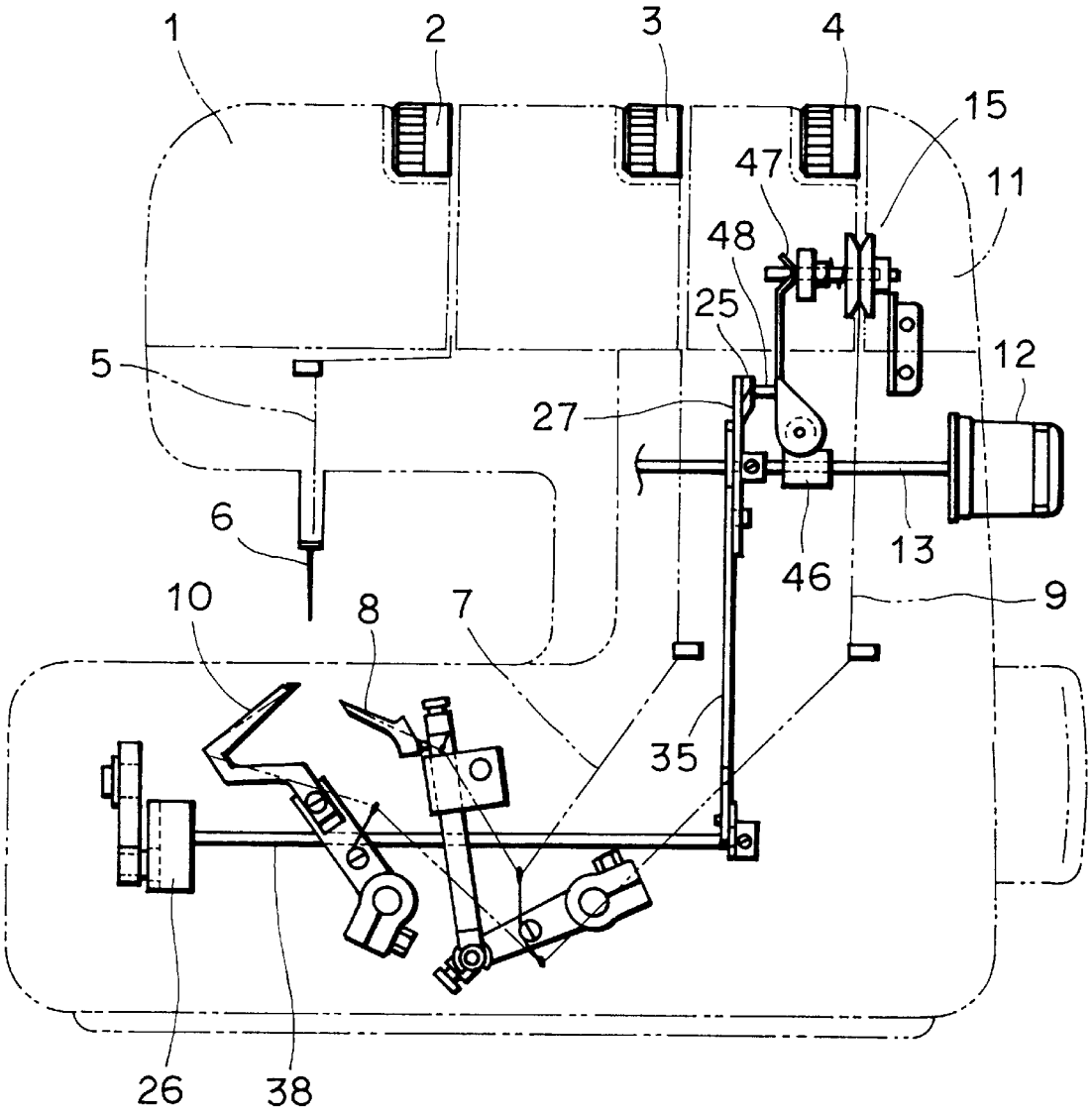
FIG. 11 is a front elevational view of an overlock sewing machine comprising a switching mechanism of still another example of the switching mechanism shown in FIG. 3.
Figure 12:
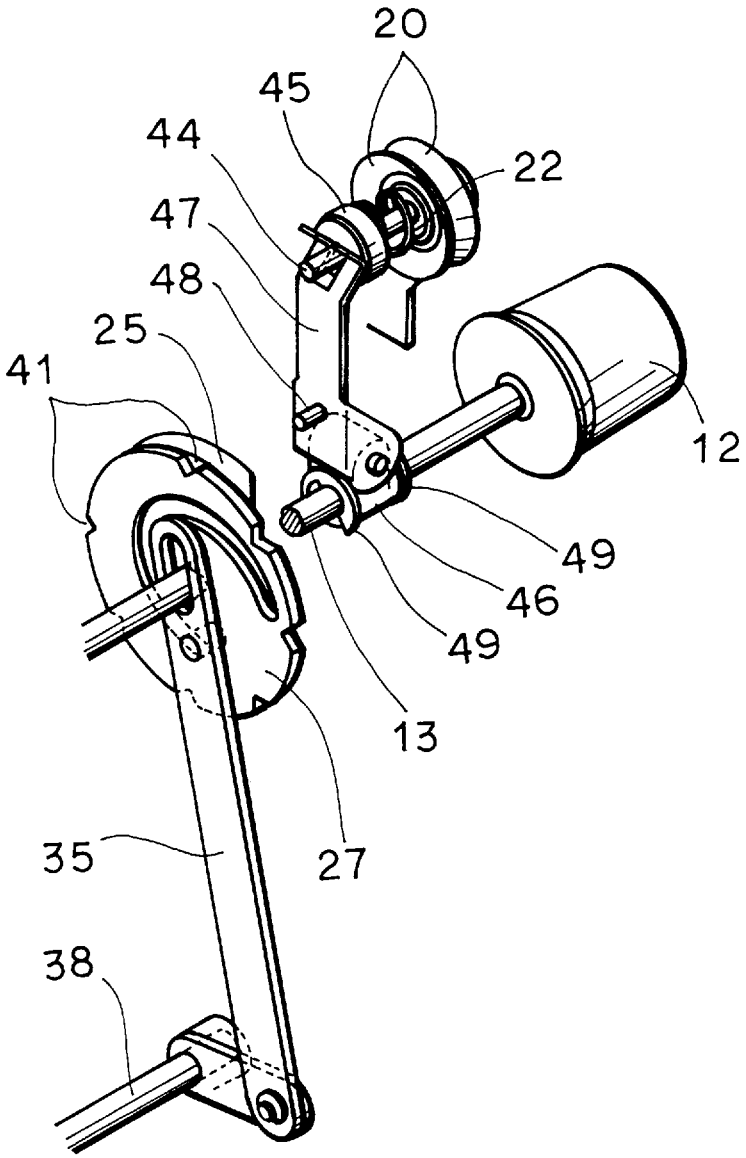
FIG. 12 is a perspective view of the switching mechanism shown in FIG. 11.

With reference to FIGS. 11 and 12, an example of an overlock sewing machine comprising still another switching mechanism is now described. In this example, an end cam 25 is formed on a peripheral edge of a feed rate adjusting cam 27, and a spring cap 45 of a coil spring 24 is slidably engaged in a shaft 44 of an auxiliary thread tensioner 15. A presser plate 47 pressing the spring cap 45 is rotatably pivotally supported on a support block 46 which is freely engaged with a dial shaft 13 with axial movement being restricted by a retaining ring 49. A pin 48 which is engaged with the end cam 25 is protrudingly provided on one side end of the presser plate 47.

When an over-edge chain stitch is carried out in such an apparatus, the pin 48 is engaged with a lower lift part of the end cam 25 to incline the presser plate 47 leftward in the figure. Then, the spring cap 45 is moved leftward by action of the coil spring 22, and the coil spring 22 is brought into a sufficiently extended state. Thus, no spring pressure of the coil spring 22 acts on tension discs 20, to apply no tension to a lower looper thread which is passed through the tension discs as the result. When a feed rate adjusting cam 27 is rotated by operation of the dial 12 in such a range that the pin 48 is engaged with the lower lift part of the end cam 25, the feed rate in the over-edge chain stitch is adjusted.

When a rolled seam is formed, on the other hand, the pin 48 is engaged with a high lift part of the end cam 25 to incline the presser plate 47 rightward in the figure. Thus, the spring cap 45 is moved rightward against the action of the coil spring 22. Thus, tension is applied to the lower looper thread which is passed through the tension discs. In this case, adjustment of the feed rate in the rolled seam is possible in such a range that the pin 48 is engaged with the high lift part of the end cam 25.

INDUSTRIAL AVAILABILITY

The overlock sewing machine according to the present invention is capable of readily forming a rolled seam with no requirement for a complicated tension adjusting operation. Therefore, it is widely applicable to an overlock sewing machine forming a rolled seam in addition to an over-edge chain stitch.

We claim:

1. An overlock sewing machine, comprising:

a main thread tensioner for providing a lower looper thread or a looper thread with thread tension being necessary for forming an ordinary over-edge stitch; and an auxiliary thread tensioner for providing said lower looper thread or looper thread with thread tension being necessary for forming a rolled seam along with said main thread tensioner, wherein the auxiliary thread tensioner comprises a pair of tension disks which can be adjustable inclined relative to one another, the disks being inclined to expand a spacing defined between them such that no pressure is applied by the disks to the lower looser thread passed therebetween.

2. The overlock sewing machine in accordance with claim 1, wherein:

the thread path of said lower looper thread or looper thread is not passed through said auxiliary thread tensioner in an over-edge chain stitch, and passed through said auxiliary thread tensioner in a rolled seam.

3. The overlock sewing machine in accordance with claim 1, further including:

a switching mechanism for switching said auxiliary thread tensioner between action and inaction by a manual operation.

4. The overlock sewing machine in accordance with claim 3, further comprising:

a feed rate adjusting mechanism being formed to be interlocked with said switching mechanism.

5. The overlock sewing machine in accordance with claim 4, wherein:

the feed rate of said feed rate adjusting mechanism is adjustable in an over-edge chain stitch and a rolled seam respectively.

6. (Amended) The overlock sewing machine in accordance with claim 5, wherein:

said feed rate adjusting mechanism includes:

a feed rate adjusting cam having a feed rate adjusting cam part for an over-edge chain stitch and a feed rate adjusting cam part for a rolled seam.

7. The overlock sewing machine in accordance with claim 4, wherein:

said switching mechanism includes an end cam for switching said auxiliary thread tensioner to action or inaction, said end cam being mounted on a shaft of a dial of said feed rate adjusting mechanism.

8. The overlock sewing machine in accordance with claim 1, wherein:

said main thread tensioner and said auxiliary thread tensioner are so arranged that respective thread paths are positioned in the same plane.

* * * * *